US006651681B1

(12) United States Patent
Hurskainen

(10) Patent No.: US 6,651,681 B1
(45) Date of Patent: Nov. 25, 2003

(54) METHOD AND APPARATUS FOR WASHING SURFACES OF A PROCESS DEVICE

(76) Inventor: Aarne Hurskainen, Peiponkuja 9, FIN-37600 Valkeakoski (FI)

( * ) Notice: Subject to any disclaimer, the term of this patent is extended or adjusted under 35 U.S.C. 154(b) by 0 days.

(21) Appl. No.: 09/806,688

(22) PCT Filed: Sep. 14, 1999

(86) PCT No.: PCT/FI99/00743

§ 371 (c)(1),
(2), (4) Date: Apr. 4, 2001

(87) PCT Pub. No.: WO00/20132

PCT Pub. Date: Apr. 13, 2000

(30) Foreign Application Priority Data

Oct. 5, 1998 (FI) ..... 982148

(51) Int. Cl.[7] ..... B08B 9/08

(52) U.S. Cl. ..... 134/167 R; 134/168 R; 239/227; 239/243

(58) Field of Search ..... 134/22.1, 22.18, 134/23, 24, 167 R, 168 R; 239/227, 243, 269

(56) References Cited

U.S. PATENT DOCUMENTS 3,001,534 A * 9/1961 Grant, Jr. ..... 134/167 R
3,593,728 A 7/1971 Sauer
3,856,570 A * 12/1974 McDermott ..... 134/167 R
3,874,594 A * 4/1975 Hatley ..... 134/167 R
3,878,857 A * 4/1975 Heibo ..... 134/167 R
3,981,315 A * 9/1976 Olthoff ..... 134/167 R
5,896,871 A * 4/1999 Larsen ..... 134/167 R

FOREIGN PATENT DOCUMENTS

GB 1509919 5/1978

* cited by examiner

*Primary Examiner*—Randy Gulakowski
*Assistant Examiner*—Saeed Chaudhry
(74) *Attorney, Agent, or Firm*—Connolly Bove Lodge & Hutz LLP

(57) ABSTRACT

A method and apparatus for process washing of a process device is provided. The process washing apparatus includes a washing device that moves inside the process device. A washing medium of the washing device is led at least partly inside a body of the washing device in order to lead the washing medium to a target. The washing medium is sprayed to the target by nozzles disposed in the body of the washing device. The apparatus includes first and second supply assemblies for supplying the washing medium to the nozzles. Flow of the washing medium to the first supply assembly is controlled independently of flow of the washing medium to the second supply assembly, and the supply assemblies are capable of moving independently of one another. A method of operating the apparatus including controlling the flow of the washing medium and moving the supply assemblies independently of each other is disclosed.

8 Claims, 3 Drawing Sheets

METHOD AND APPARATUS FOR WASHING SURFACES OF A PROCESS DEVICE

Figure 1B:
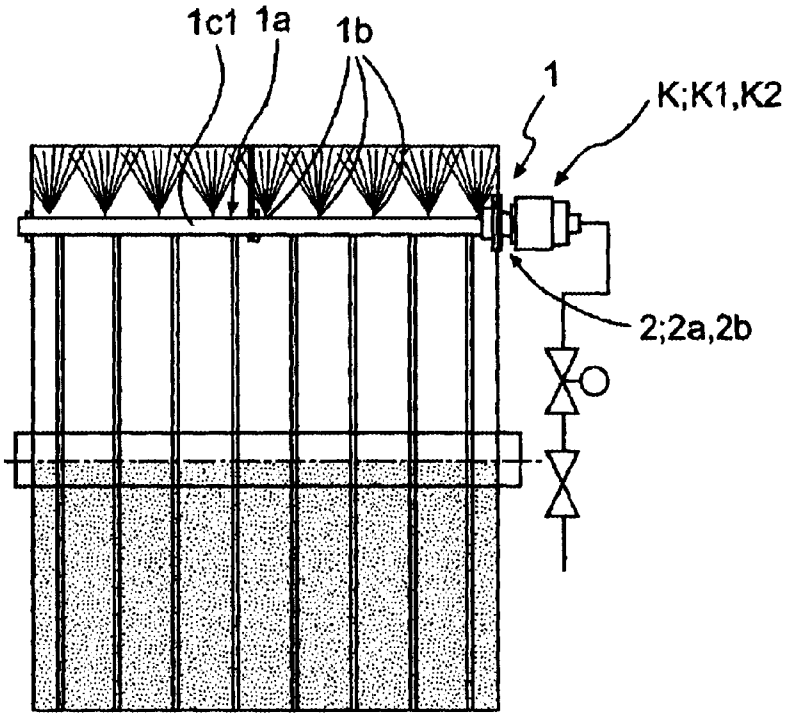
FIG. 1b PRIOR ART

The invention relates to a method for process washing, wherein a process device is being washed by washing device, that moves inside the same, whereby the washing device is connected moveably in connection with the process device by means of fastening means and, whereby the washing medium of the washing device is being led at least partly inside the body of the washing device in order to lead the washing medium furthermore to a target by spraying or correspondingly by means of nozzles existing in the body of the washing device.

It is nowadays known to use washing devices for process washing, in which the supply assembly for the washing medium is being led totally through the washing device, such as through its body and at least partly inside the fastening means connecting the same to the process device, such as an attachment frame fastened e.g. with screws, and also e.g. partly inside a running motor and gear acting as the driving device. Furthermore depending on the process device, the washing device comprises e.g. according to FIGS. 1*a* and 1*b* a body, that rotates around an axis, that is essentially perpendicular to its longitudinal axis, or, that rotates essentially around its longitudinal axis, which body is equipped with nozzles in order to direct the washing medium being led through the same to the surfaces to be washed of the process device. For the purpose described above it is known to use most heterogeneous washers, the operating principle of which is to act by influence of the pressure or flow of the washing liquid or, that are as described above moveable by external power.

Nowadays one problem in practice is such, that in process devices having most heterogeneous internal surfaces and components in practice, the washing medium is being sprayed continuously by all of the nozzles of the washing device simultaneously. Particularly as the amount/the washing effect of the washing medium is being optimized, it is, due to the above, usually not possible to aim an adequate washing effect e.g. at certain separate points or components, because in such a case a large amount of the washing medium would be wasted or in other words aimed at so called empty points. This is why in process devices of certain type, that have e.g. a particularly complex internal structure, it is not possible by today's washing techniques to achieve a washing result good enough with proportionate maintenance costs.

It is the aim of the method according to this invention to achieve a decesive improvement in the problems described above and thus to raise essentially the level of prior art. In order to achieve this aim, the method according to the invention is primarily characterized by, that the washing medium or like is being led by at least two separate supply assemblies existing in the same washing device, in order to enable use of each supply assembly, such as spraying of the washing medium and/or moving of the supply assembly, independently in respect with each other by means of a control assembly.

As the most important advantages of the method according to the invention may be mentioned simplicity and efficiency of its principle and the structures applicable for the same in most heterogeneous processes. Thanks to the method according to the invention, it is thus possible to improve significantly the washing of particularly more complicated process devices by washing measures, that may be directed at each time accurately to a special target. The method according to the invention may be adapted especially profitably e.g. in that way, that the flow of the washing medium through the second supply assembly is being interrupted during situations, when there is no need for the special wash in question, whereby the first supply assembly acts correspondingly independently according to its own rutines either periodically or continuously. Thanks to the method according to the invention it is furthermore possible to vary the amount of washing medium and also change the washing media of each supply assembly as well as pressures, whereby it is possible e.g. by means of the second supply assembly to extend the washing effect even significantly further out than with traditional solutions e.g. thanks to the fact, that a higher operating pressure is available.

The invention relates also to an apparatus operating according to the method, that is described in a greater detail in the preamble of the independent claim related to the same. The primary characteristics of the apparatus are represented in the characterizing part of the corresponding claim.

As the most important advantages of the apparatus according to the invention may be mentioned simplicity and reliability of its construction and use. The apparatus according to the invention enables furthermore a very effective washing process, that may be easily adjusted to each process, whereby it is also possible to optimize the service and maintenance costs also for the part of the washing process. The apparatus according to the invention is designed profitably e.g. in such a way, that each supply assembly is being led totally inside the body of the washing device. In this case e.g. the auxiliary frame forming the second supply assembly and the nozzles existing therein are attached e.g. stationarily to the actual body of the actual washing device, in order to move both the body and the frame simultaneously by influence of one and the same driving device. On the other hand, when e.g. a washing device is being used, that rotates around its longitudinal axis, the apparatus according to the invention may be put together in principle on the same principle e.g. by one or several extension frames, that have been placed e.g. at the end of the body and that have nozzles for this action of the washing process.

Figure 1A:
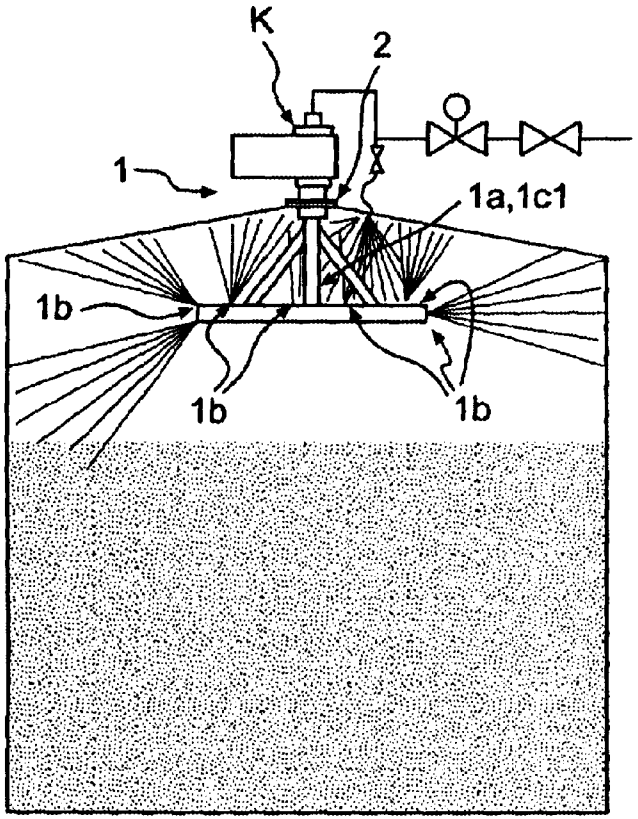
FIG. 1a PRIOR ART
Figure 2:
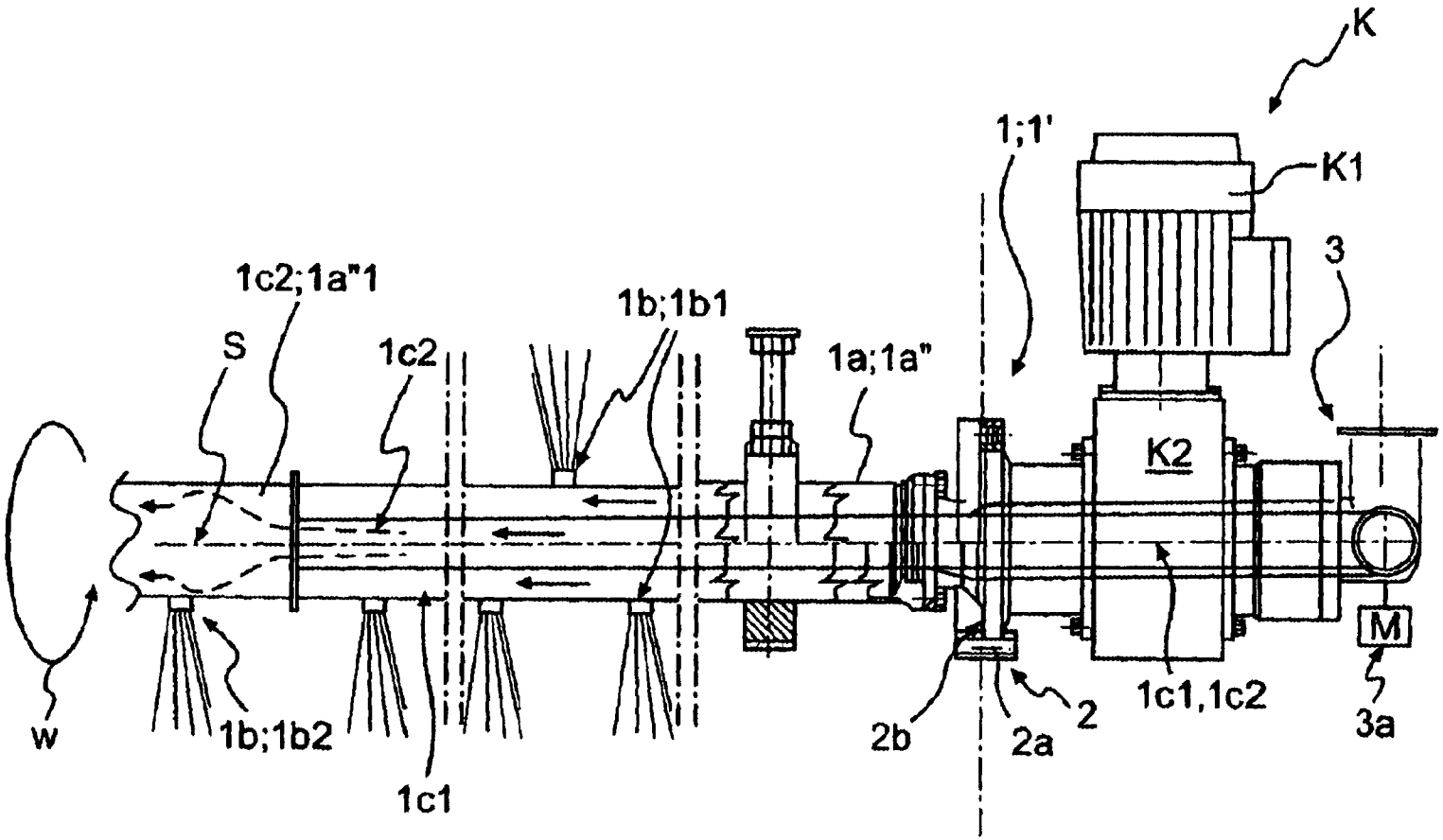
Figure 3:
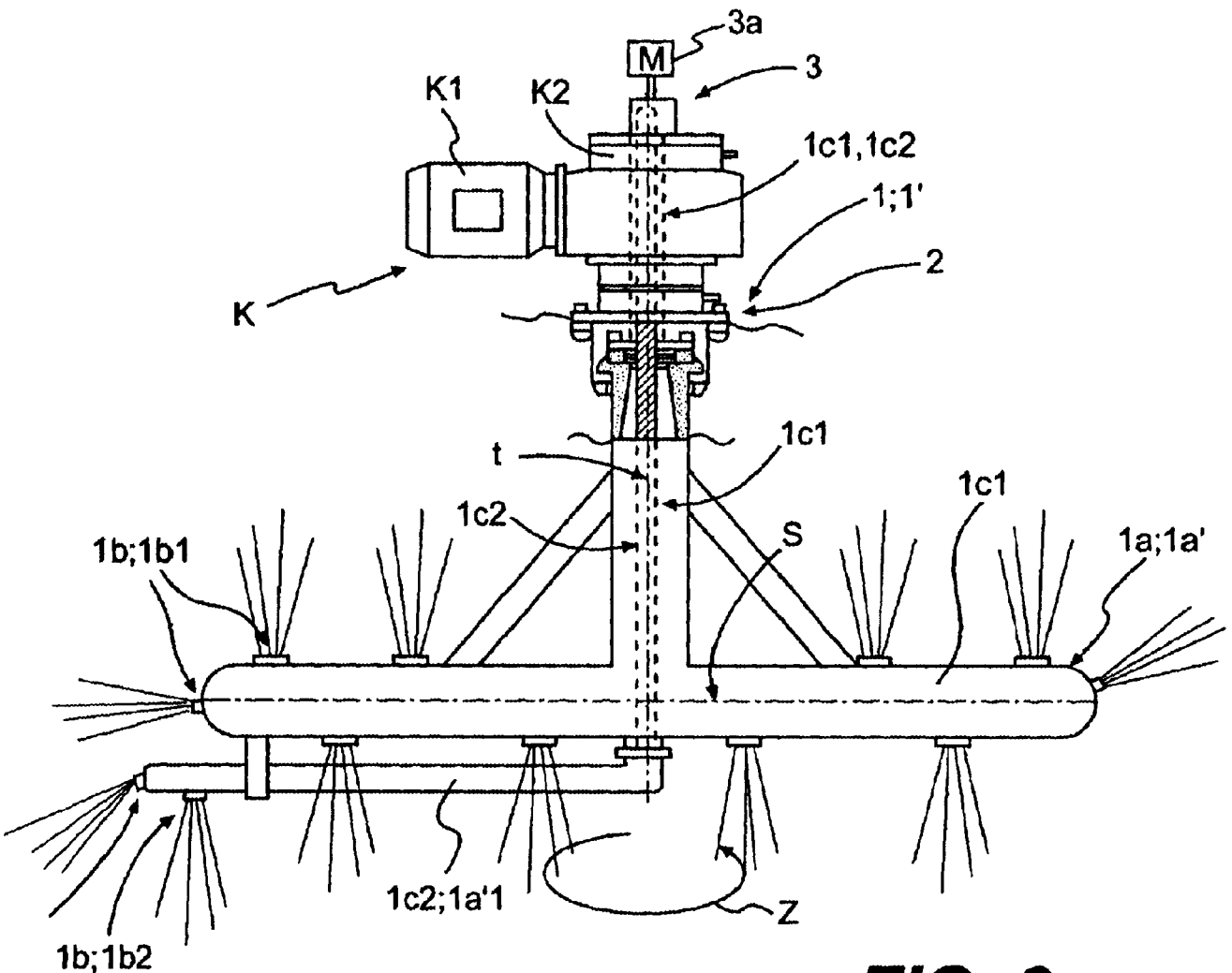

In following description, the invention is described in detail with reference to the appended drawings, in which FIGS. 1*a* and 1*b* show some usual washing devices being used for process washing, FIG. 2 shows an advantageous embodiment of the method according to the invention in connection with a washing device structure and FIG. 3 shows an advantageous embodiment of the method according to the invention in connection with a washing device, that is an alternative to the one shown in FIG. 2.

The invention relates to a method for process washing, wherein a process device is being washed by a washing device, that moves inside the same, whereby the washing device 1 is connected moveably in connection with the process device by means of fastening means 2 and, whereby the washing medium of the washing device is being led at least partly inside the body 1*a* of the washing device in order to lead the washing medium furthermore to a target by spraying or correspondingly by means of nozzles 1*b* existing in the body 1*a* of the washing device. The washing medium or like is being led by at least two separate supply assemblies 1*c*1, 1*c*2 existing in the same washing device 1; 1', in order to enable use of each supply assembly 1*c*1, 1*c*2, such as spraying of the washing medium and/or moving the supply assembly, independently in respect with each other by means of a control assembly 3.

As an advantageous embodiment e.g. according to FIGS. 2 and 3, at least one supply assembly 1*c*1 for the washing medium of a washing device, that is moveable by means of a driving device K, is being led totally through the washing device, such as through its body 1*a* and at least partly inside the fastening means 2, such as an attachment frame 2*b*, fastened with screws 2*a*, or a like, connecting the same to the process device, and inside the driving device K, such as a motor K1 and gear K2 or a like. When applying the method according to the invention, the second supply assembly 1*c*2 for the washing medium is being led together with the first supply assembly 1*c*1 in a corresponding matter totally inside the washing device 1; 1'.

Furthermore as an advantageous embodiment of the method, the flow and/or movement of the washing medium of the first and/or the second supply assembly 1*c*1 and/or 1*c*2 is being adjusted independently in respect with each other by means of flow regulating means 3*a* and/or actuator means belonging to the control assembly 3. In the presented embodiments there has not been shown any actual actuator means for moving of the second supply assembly, because all the shown applications present totally stationary solutions in principle, in which the supply assemblies move together by influence of one and the same driving device K.

Thus the nozzles 1*b*1, 1*b*2 being connected to the first and the second supply assemblies 1*c*1, 1*c*2 are arranged stationarily essentially to the same body 1*a*, whereby the independent operating in respect with each other of the said supply assemblies 1*c*1, 1*c*2 is being achieved by periodically interrupting the flow of the washing medium, that is being led through one or several supply assemblies, by means of flow regulating means 3*a*, such as a motor actuated valve or like, or correspondingly.

On the principles described above, the apparatus according to the invention comprises, instead of those traditional washing devices shown in FIGS. 1*a* and 1*b*, at least two separate washing medium supply assemblies 1*c*1, 1*c*2, in order to enable use of each supply assembly 1*c*1, 1*c*2, such as spraying of the washing medium and/or moving of the supply assembly, independently in respect with each other by means of a control assembly 3.

Particularly in FIG. 3 there is shown an embodiment, in which the washing device comprises a body 1*a*', that rotates z around an axis t, that is essentially perpendicular to its longitudinal axis s. In this case the second supply assembly 1*c*2 comprises at least one auxiliary frame 1*a*'1, that is connected to the body 1*a*' and, in which the nozzles 1*b*2 of the second supply assembly 1*c*2 are placed.

When using an alternative application according to the one shown in FIG. 2, the washing device comprises a body 1*a*", that rotates w around its longitudinal axis s, whereby the second supply assembly 1*c*2 comprises at least one extension frame 1*a*"1, that is placed at the end of the body a" and, in which the nozzles 1*b*2 of the second supply assembly 1*c*2 are placed.

In both of the above embodiments, the control assembly 3 comprises flow regulating means 3*a* and/or actuator means, in order to adjust the flow and/or movement of the washing medium of the first and/or the second supply assembly 1*c*1, 1*c*2 independently in respect with each other. As a particularly advantageous embodiment with reference to the solutions shown in FIGS. 1 and 2, the nozzles 1*b*l, 1*b*2 being connected to the first and second supply assemblies 1*c*1, 1*c*2, are arranged stationarily essentially to the same body 1*a*, whereby the independent operating in respect with each other of the said supply assemblies, is arranged by periodically interrupting the flow of the washing medium, that is led through one or several supply assemblies, by means of flow regulating means 3*a*, such as a motor actuated valve or like.

It is obvious, that the invention is not limited to the embodiments described above, but it can be modified within the basic idea of the invention to a great extent. First of all the body of the washing device may be, differing from the T-shape shown e.g. in FIG. 3, L-shaped or it may be formed of three or more horizontal bodies, that are attached to the center body radially. Correspondingly the body of the embodiment according to FIG. 2, may be free from its second end, into which the extension frame has been connected, or it may be mounted in bearings at both of its ends to the washing device. In addition to the above, the nozzles of the first and second supply assemblies may e.g. be placed in turns on the body in the longitudinal direction. It is furthermore naturally possible to exploit an auxiliary washer as shown e.g. in FIG. 1*a*, in order to wash the washing device itself by a flow of washing medium being led from the nozzle in question. It is on the other hand possible to apply the method and apparatus according to the invention also in that way, that the supply assembly comprises more part entireties than presented above to feed furthermore e.g. oxygen, steam or a certain chemical substance continuously or periodically to the surfaces of the washing device or to the process. It is furthermore naturally clear, that the method and apparatus according to the invention may be adapted in connection with a washing device, that is moveable in any possible way, so that the presented embodiments are intended only to show certain common ways based on traditional washing device structures to carry out the invention.

What is claimed is:

1. A washing apparatus for washing an internal portion of a process device, the apparatus comprising:

a washing device disposed inside of the process device, wherein the washing device is moveably connected to the process device by a fastening means, said washing device comprising:

a body, wherein a washing medium is arranged to flow at least partly inside the body and wherein the body rotates around an axis that is essentially perpendicular to a longitudinal axis of the body;

a first supply assembly arranged to carry a washing medium;

a second supply assembly arranged to carry the washing medium, wherein the second supply assembly comprises at least one auxiliary frame that is connected to the body and wherein the first and second supply assemblies are arranged together inside the body;

a first plurality of nozzles disposed in the body and connected to the first supply assembly;

a second plurality of nozzles disposed in the at least one auxiliary fame and connected to the second supply assembly, wherein the first plurality of nozzles and second plurality of nozzles are arranged to spray the washing medium to a target; and a control assembly arranged to control the first and second supply assemblies such that the first and second supply assemblies are capable of spraying the washing medium and moving independently with respect to each other.

2. The washing apparatus of claim 1, wherein the washing device is moveable by a driving device including a motor and a gear, wherein at least one of the first and second supply assemblies is led totally through the body, at least partly inside the fastening means, and inside the driving device, wherein the fastening means comprises an attachment frame fastened with screws connecting the attachment frame to the process device, and wherein the control assembly comprises a flow regulating means or actuator means for adjusting the flow of the washing medium and movement of the first and second supply assemblies independently with respect to each other.

3. The washing apparatus of claim 2, wherein the first plurality of nozzles and the second plurality of nozzles are arranged essentially stationarily to the body, whereby the first and second supply assemblies are enabled to spray the washing medium and move independently with respect to each other by periodically interrupting flow of the washing medium.

4. The washing apparatus of claim 1, wherein the first plurality of nozzles and the second plurality of nozzles are attached essentially stationarily to the body, whereby the first and second supply assemblies are enabled to spray the washing medium and move independently with respect to each other by periodically interrupting flow of the washing medium, wherein the control assembly comprises a flow regulating means for adjusting the flow of the washing medium and movement of the first and second supply assemblies independently with respect to each other, wherein the washing medium is led through at least one of the first and second supply assemblies via the flow regulating means.

5. A washing apparatus for washing an internal portion of a process device, the apparatus comprising:

a washing device disposed inside of the process device, wherein the washing device is moveably connected to the process device by a fastening means, said washing device comprising:

a body, wherein a washing medium is arranged to flow at least partly inside the body and wherein the body rotates around a longitudinal axis of the body;

a first supply assembly arranged to carry a washing medium;

a second supply assembly arranged to carry the washing medium, wherein the second supply assembly comprises at least one extension frame that is arranged at an end of the body and wherein the first and second supply assemblies are arranged together inside the body;

a first plurality of nozzles disposed in the body and connected to the first supply assembly;

a second plurality of nozzles disposed in the at least one extension frame and connected to the second supply assembly, wherein the first plurality of nozzles and second plurality of nozzles are arranged to spray the washing medium to a target; and a control assembly arranged to control the first and second supply assemblies such that the first and second supply assemblies are capable of spraying the washing medium and moving independently with respect to each other.

6. The washing apparatus of claim 5, wherein the washing device is moveable by a driving device including a motor and a gear, wherein at least one of the first and second supply assemblies is led totally through the body, at least partly inside the fastening means, and inside the driving device, wherein the fastening means comprises an attachment frame fastened with screws connecting the attachment frame to the process device, and wherein the control assembly comprises a flow regulating means or actuator means for adjusting the flow of the washing medium and movement of the first and second supply assemblies independently with respect to each other.

7. The washing apparatus of claim 6, wherein the first plurality of nozzles and the second plurality of nozzles are attached essentially stationarily to the body, whereby the first and second supply assemblies are enabled to spray the washing medium and move independently with respect to each other by periodically interrupting flow of the washing medium.

8. The washing apparatus of claim 5, wherein the first plurality of nozzles and the second plurality of nozzles are attached essentially stationarily to the body, whereby the first and second supply assemblies are enabled to spray the washing medium and move independently with respect to each other by periodically interrupting flow of the washing medium, wherein the control assembly comprises a flow regulating means for adjusting the flow of the washing medium and movement of the first and second supply assemblies independently with respect to each other, wherein the washing medium is led through at least one of the first and second supply assemblies via the flow regulating means.

* * * * *